US006133897A

United States Patent [19]

Kouchi

[11] Patent Number: 6,133,897

[45] Date of Patent: Oct. 17, 2000

[54] ACTIVE MATRIX LIQUID CRYSTAL LIGHT VALVE WITH DRIVE CIRCUIT

[75] Inventor: Tetsunobu Kouchi, Hiratsuka, Japan

[73] Assignee: Canon Kabushiki Kaisha, Tokyo, Japan

[21] Appl. No.: 08/829,795

[22] Filed: Jan. 18, 1995

Related U.S. Application Data

[63] Continuation of application No. 08/176,515, Jan. 3, 1994, abandoned, which is a continuation of application No. 08/010,629, Jan. 28, 1993, abandoned.

[30] Foreign Application Priority Data

Jan. 31, 1992 [JP] Japan ..... 4-040581

[51] Int. Cl.[7] ..... G09G 3/36

[52] U.S. Cl. ..... 345/100; 345/98; 345/204; 345/211

[58] Field of Search ..... 345/87, 90, 92, 345/98, 99, 100, 204, 211; 349/41–42; 377/64, 69, 77, 81

[56] References Cited

U.S. PATENT DOCUMENTS

| | | | |
|---|---|---|---|
| 4,724,433 | 2/1988 | Inoue et al. | 340/805 |
| 4,779,956 | 10/1988 | Nemoto et al. | 340/784 |
| 5,041,823 | 8/1991 | Johnson et al. | 340/784 |
| 5,061,920 | 10/1991 | Nelson | 340/784 |
| 5,105,187 | 4/1992 | Plus et al. | 340/784 |
| 5,162,860 | 11/1992 | Nami et al. | 358/75 |
| 5,252,957 | 10/1993 | Itakura | 345/98 |
| 5,253,093 | 10/1993 | Takeda et al. | 345/87 |
| 5,412,397 | 5/1995 | Kanatani et al. | 345/100 |

FOREIGN PATENT DOCUMENTS

| | | | |
|---|---|---|---|
| 0293156 | 11/1988 | European Pat. Off. . | |
| 0381429 | 8/1990 | European Pat. Off. | 345/98 |
| 2532777 | 3/1984 | France . | |
| 2146478 | 4/1985 | United Kingdom | G09G 3/18 |

*Primary Examiner*—Lun-Yi Lao

*Attorney, Agent, or Firm*—Fitzpatrick, Cella, Harper & Scinto

[57] ABSTRACT

A technology is disclosed in which the voltage of a drive signal pulse to be supplied to a switch, which transfers a signal to be supplied to a liquid crystal cell, is raised. A plurality of lines for the signals to be supplied to a switch array which transfers the signal to be supplied to the liquid crystal cell is provided so as to supply drive signal pulses for operating switches which correspond to a plurality of the lines while time sequentially overlapping the drive signal pulses.

2 Claims, 16 Drawing Sheets

ACTIVE MATRIX LIQUID CRYSTAL LIGHT VALVE WITH DRIVE CIRCUIT

This application is a continuation of application Ser. No. 08/176,515 filed Jan. 3, 1994, now abandoned, which is a continuation of application Ser. No. 08/010,629 filed Jan. 28, 1993, now abandoned.

BACKGROUND OF THE INVENTION

1. Field of the Invention

The present invention relates to an active matrix liquid crystal light valve (AMLCV) for switching a liquid crystal cell by an active element thereof, to a liquid crystal display apparatus (LCD) having the light valve, and to an image information processing apparatus having the LCD.

2. Related Background Art

Hitherto, a liquid crystal display (LCD) having an active element has been, as an AMLCV, widely used in a structure which comprises twisted nematic (TN) liquid crystal, and have been marketed as a flat panel display or a projection TV monitor. The active element typified by a thin film transistor (TFT), or a diode or a MIM (Metal Insulator Metal Element) enhances the optical switch response of TN liquid crystal which suffers from relatively slow response, by keeping a state, in which the TN liquid crystal is being applied with voltage, for a period longer than the actual line selection period. Furthermore, the active element causes liquid crystal device such as the TN liquid crystal having no memory characteristics (self-holding characteristics) to have a substantial memory state for each unit cell for one frame by keeping the aforesaid voltage applied state. The LCD has excellent display characteristics because it is theoretically freed from crosstalk between lines and between pixels thereof.

Recently, ferroelectric liquid crystal (FLC) revealing the response speed higher than that of the TN liquid crystal by a degree of several digits has been developed energetically, resulting in display panels and light valves using the same to be disclosed. In the aforesaid circumstance, there is a possibility that a further excellent display device can be obtained by driving the FLC by the active matrix device. As an example structured by combining the FLC and the TFT has been disclosed in, for example, U.S. Pat. No. 4,840,426 and in Proceeding of the SID, vol. 30, 1989 "Ferroelectric Liquid-Crystal Video Display" vol. 30, 1989.

FIG. 11 illustrates a conventional liquid crystal display circuit.

The circuit shown in FIG. 11 comprises a unit pixel composed of a common electrode COM, a liquid crystal cell 701 filled with liquid crystal material between its pixel electrodes CE, and a pixel TFT 702. The circuit still further comprises a signal line 703, a line buffer 704, a shift pulse switch 708, and a horizontal shift register 705 for transmitting video signals. The circuit further comprises a gate line 711 and a vertical shift register 706 for transmitting gate signals. The video signals are received by a signal input terminal 707 so as to be sequentially transferred to each pixel or each line while having their timing shifted.

FIG. 12 illustrates the timing of drive pulses for use in the conventional active matrix liquid crystal display device shown in FIG. 11. FIG. 12 illustrates the timing of the drive pulses for use in a line sequential drive method. That is, video signal Sv to be recorded on the liquid crystal is recorded in such a manner that video signals for one line are recorded on the buffer portion via a shift pulse switch 708 which is operated by the horizontal shift register 705 arranged to transmit an output in synchronization with the frequency of the video signal Sv. After the video signals for all of the pixels for one line have been recorded to the line buffer portion 704, the video signal is recorded to each liquid crystal cell via a pixel switch, which has been switched on by an output switch of the line buffer portion 704 and the vertical shift register 706. The signals are usually transferred to each liquid crystal cell during a blanking period of a horizontal scanning period or transferred collectively to a certain horizontal line in response to pulse $\phi t$. At the aforesaid timing, the video signals are sequentially transferred to each line.

When molecules of the liquid crystal, which forms the cell, move in accordance with the voltages of the signals thus transferred, the transmittance of the liquid crystal cell is changed in accordance with the direction of the deflection plate individually provided to have a relationship of a cross polarizer. The aforesaid state is shown in FIG. 13.

The voltage of the signal shown in the axis of abscissa of FIG. 13 is meant different facts depending upon the type of liquid crystal. For example, the values are defined to be effective voltage values (Vrms) in the case of the TN liquid crystal. The qualitative description of the aforesaid value will be made with reference to FIG. 14. In order to prevent a fact that DC components are applied to the liquid crystal for a long time, there is a method in which the polarity of the signal voltage is altered for each frame at the time of supplying the signal. In this case, the liquid crystal acts in accordance with the AC voltage component shown by a portion designated by a diagonal line. Therefore, execution voltage $V_{rms}$ is expressed as follows when the time for two frames is $t_F$ and the signal voltage to be transferred to the liquid crystal is $V_{LC}$ (t):

$$V_{\text{rms}} = \sqrt{\frac{1}{t_F}\int_0^{t_F}(V_{LC}(t) - V_{COM})^2 dt}\,.$$

On the other hand, the FLC is ordinarily driven by DC voltage. In a case where FLC of a type having a bistable state is employed (it is preferable that chiral smectic liquid crystal be used, further preferable chiral smectic liquid crystal such as phase C (SmC*), phase H (SmH*), SmI*, SmF* or SmG* chiral smectic liquid crystal be used), drive waveforms shown in FIG. 15 are offered. That is, the signal voltage is reset to either of the bistable states in accordance with reset voltage $V_R$ before the signal is written, and then writing voltage signal ($V_M$) is applied. Also the signal voltage contributing to the transmittance shown in FIG. 13 is designated by diagonal lines. In a manner different from the TN liquid crystal, the DC component of the writing voltage is the signal voltage as it is.

Although the voltage of the pixel electrode is changed in accordance with the signal voltage if the drive method shown in FIG. 12 is used, it is always positive with respect to the potential of the common electrode of the liquid crystal similarly to the case where a DC voltage component is always applied to the liquid crystal cell. In the case where the TN liquid crystal is used as the liquid crystal material, the aforesaid DC component causes a problem to arise in that the liquid crystal molecules can be burnt.

Methods of removing the DC voltage component is typified by a method of reversing the signal voltage for each frame arranged as shown in FIG. 14. The signal voltage at the N-th time is so applied as to be positive with respect to the potential of the common electrode, while the signal voltage at the (N+1)-th time is so applied as to be negative. By reversing the polarity of the signal voltage with respect to the potential of the common electrode for each frame as described above, the DC voltage components to be applied to the liquid crystal cell are set off so that burning of the liquid crystal molecules can be prevented.

Similarly, a method of reversing the same for each 1H and a method of reversing the same for each pixel may be employed. However, the aforesaid reversing drive method arises the following problems.

Assuming that the maximum value of the signal voltage is $V_{MAX}$, the shift register portion must have, regardless of the type of the reversing method, performance capable of transferring a signal having an amplitude which is two times the VMAX if the reversing drive method is employed. Therefore, the shift register portion must, of course, be able to withstand the ON/OFF voltage.

As a means for relaxing the required condition about the voltage resistance, it might be feasible to employ a method in which the maximum amplitude of the signal voltage is reduced. However, the aforesaid means cannot be preferably adapted to a high vision display which is expected to be rapidly widely used in the future and which must have excellent precision because it is difficult to keep the gradation as can be understood from FIG. 13.

Another method can be employed in which a voltage-resisting MOS transistor such as a LDD (Lightly Doped Drain) serving as a switch is used as a transistor which constitutes the shift register. However, the aforesaid voltage-resisting MOS transistor, which is being developed currently, arises a problem in that the mutual conductance (gm) is lowered due to enlargement of the resistance, which is in series applied to the source and the drain although it is able to improve the voltage resistance. As described above, the LCV must be, as an active device, driven at further high speed as in the case of the high vision display. Therefore, the TFT must have a larger gm. What is worse, the MOS transistor having the voltage resistance as described above can be manufactured only from a complicated process, causing problems to arise in that the yield deteriorates when it is used to constitute the shift resistor and that the manufacturing cost cannot be reduced.

There is another desire of improving the drive speed in addition to the aforesaid desire of improving the voltage resistance in order to display an excellent image. In particular, it is necessary to raise the speed of writing data to the line buffer in the case where the line sequential drive method is employed. Although it might be considered to raise the frequency of the shift pulse in order to achieve this, the circuit shown in FIG. 11 and the drive method shown in FIG. 12 cannot satisfactorily raise the aforesaid frequency.

In a circumstance in which the quantity of information is enlarged, the aforesaid problem causes software to bear a larger load or causes hardware such as the memory quantity and the microprocessor (MPU) to bear a larger load.

SUMMARY OF THE INVENTION

An object of the present invention is to overcome technological problems related to the aforesaid voltage resistance by improving the drive circuit.

A further object of the present invention is to overcome technological problems taken place in processing signals and independently from the aforesaid problem of the voltage resistance by improving the drive circuit and drive timing.

A still further object of the present invention is to reduce the size of peripheral equipment or to simplify software.

The aforesaid first to third objects can be achieved by an active matrix liquid crystal light valve having a plurality of cells each including liquid crystal and an active element, the active matrix liquid crystal light valve comprising: a circuit which operates a switch for transferring signals to be respectively supplied to the cells and which has a shift register and voltage raising means for raising the voltage of the shift register.

The aforesaid first to third objects can be achieved by a liquid crystal display and an image information processing apparatus having the aforesaid display, the liquid crystal display comprising liquid crystal display means, in which a plurality of cells each having liquid crystal and an active element are disposed in a matrix manner, and a drive circuit for operating the display means, wherein the drive circuit includes a switch for transferring signals to be supplied to a plurality of the cells, a shift register for generating a shift pulse, a voltage raising circuit for raising the voltage of the shift pulse of the shift register, and the output from the voltage raising circuit is supplied to the switch, so that the switch is operated.

The aforesaid first to third objects can be achieved by a liquid crystal display and an image information processing apparatus having the aforesaid display, the liquid crystal display comprising liquid crystal display means, in which a plurality of cells each having liquid crystal and an active element are disposed in a matrix manner, and a drive circuit for operating the display means, wherein the drive circuit includes a switch array for transferring image signals to be supplied to a plurality of the cells, and a pulse generating circuit for generating time sequential pulses for sequentially operating the switch array, and a plurality of signal lines are provided which supply the signals to the switch array so that the time sequential pulses are supplied to the switch array while at least partially overlapping said time sequential pulses.

Other and further objects, features and advantages of the invention will be appear more fully from the following description.

DETAILED DESCRIPTION OF THE PREFERRED EMBODIMENTS

Figure 1:
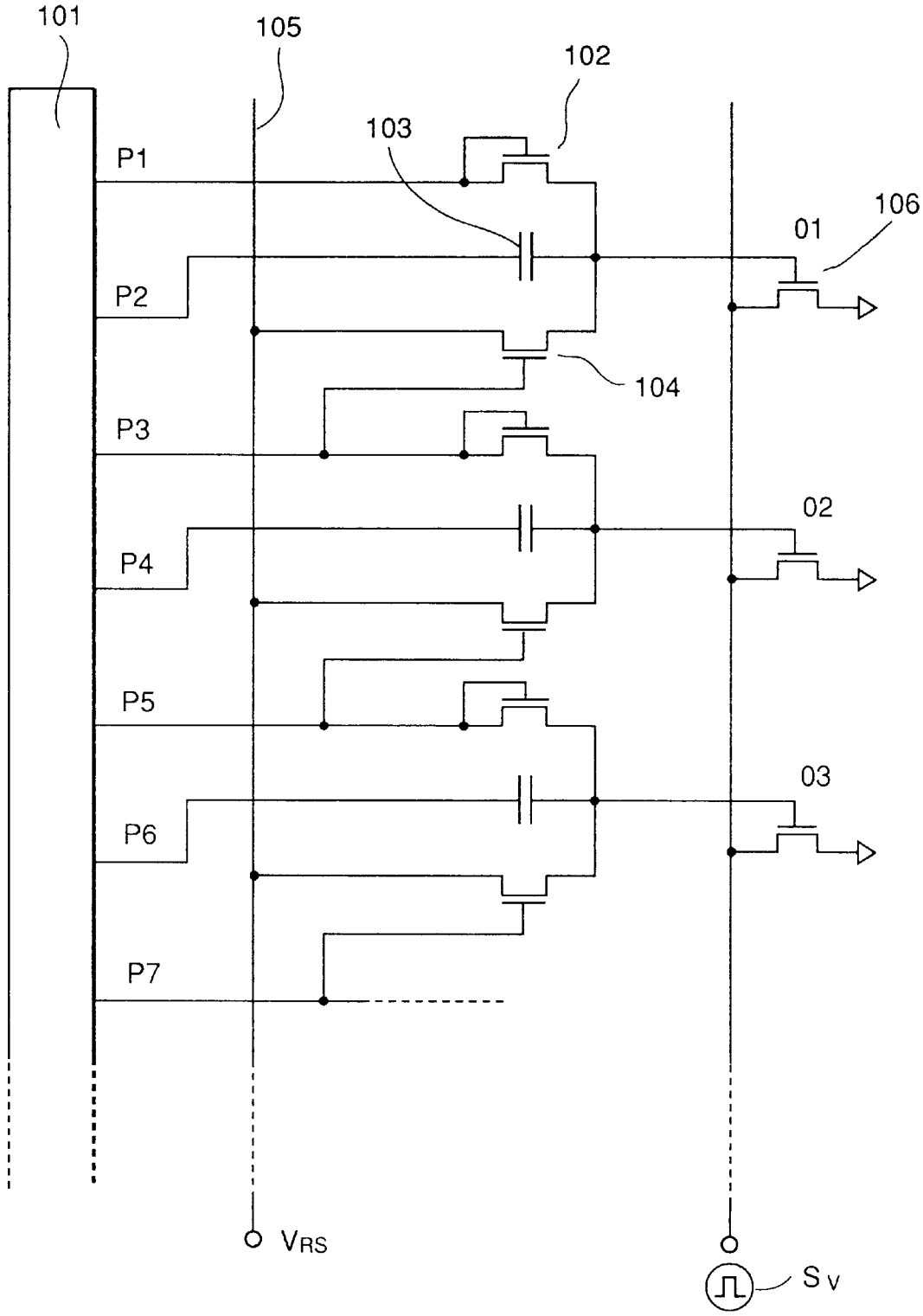
FIG. 1 illustrates a drive circuit for use in an active matrix liquid crystal light valve according to Embodiment 1 of the present invention.

A first aspect of the present invention is arranged in such a manner that the voltage of drive signal pulses supplied to a switch for transferring the signal to be applied to a liquid crystal cell is raised. As a result of the aforesaid structure, the complicated structure required to improve the voltage resistance of a transistor or the like which constitutes the shift register can be omitted. It leads to a fact that devices revealing excellent performance can be manufactured while maintaining an excellent yield.

A second aspect of the present invention is arranged in such a manner that a plurality of lines are connected to a switch for transferring signals to be supplied to a liquid crystal cell, and drive signal pulses are supplied to the switch while being overlapped in a time sequential manner in order to drive the switch adapted to a plurality of the lines. As a result of the structure thus arranged, the speed of processing the image (video) signals can be raised, also causing an effect to be obtained in that devices revealing excellent performance can be manufactured while maintaining an excellent yield. Furthermore, the size of software and hardware of peripheral equipment can be reduced.

The present invention can be used in liquid crystal printers, light valves for liquid crystal displays, and image processing apparatuses on which the aforesaid light valves are mounted. The active element, the transferring switch, the shift register and the voltage-raising means are preferably integrally formed on one substrate. It is preferable that the substrate has a semiconductor region on an insulating film thereof. The reason for this lies in that use of the substrate of the aforesaid type enables a light transmissive type liquid crystal light valve including a peripheral circuit to be formed easily.

It is preferable that the voltage raising means according to the first aspect of the present invention be formed by using a transistor, or a capacitor or a diode.

A plurality of the lines according to the second aspect of the present invention are arranged to receive a plurality of element signals which constitute the video signal, the element signal being synthesized so as to be one video signal. In particular, use of color decomposition signals such as a red signal, a green signal and a blue signal as the element signals enables the signal processing speed for forming a complicated color image to be easily raised.

More preferably, writing data to the line buffer can be completed quickly if the second aspect is adopted so as to be adapted to the line sequential drive, causing a sufficient time for performing the time sequential process of other signals in parallel to be possessed.

Then, preferred embodiments of the present invention will now be described in detail. It is understood that the present disclosure of the preferred form has been changed in the details of construction and the combination and arrangement of parts may be resorted to without departing from the spirit and the scope of the invention as hereinafter claimed.

Embodiment 1

FIG. 1 illustrates a drive circuit for use in an active matrix device according to this embodiment. Referring to FIG. 1, reference numeral 101 represents a shift register, and P1 to P7 represent output terminals of the shift register 101. Reference numeral 102 represents a first MOS transistor having the gate and the source which are connected to the first output terminal P1 of the shift register 101. Reference numeral 103 represents a first capacitor having a first electrode connected to the second output terminal P2 of the shift register 101. Reference numeral 104 represents a second MOS transistor having the gate connected to the third output terminal P3 of the shift register 101 and having the source connected to a reset power supply line 105 connected to a reference power source $V_{RS}$ for supplying resetting reference voltage. The drain of the first MOS transistor, the second electrode of the first capacitor 103 and the drain of the second MOS transistor are connected to one another so as to be a first output terminal 01. A structure constituted similarly to that described above, the MOS transistor and the capacitor are connected to the third output terminal P3, the fourth output terminal P4 and the fifth output terminal P5 of the shift register so as to be a second output terminal 02. Then, connections are performed similarly to the description above while performing shifting by a degree of two terminals. Reference numeral 106 represents a switching transistor which is controlled in response to a signal from the shift register 101.

The specific operation will now be described with reference to an operation timing chart shown in FIG. 2.

Figure 2:
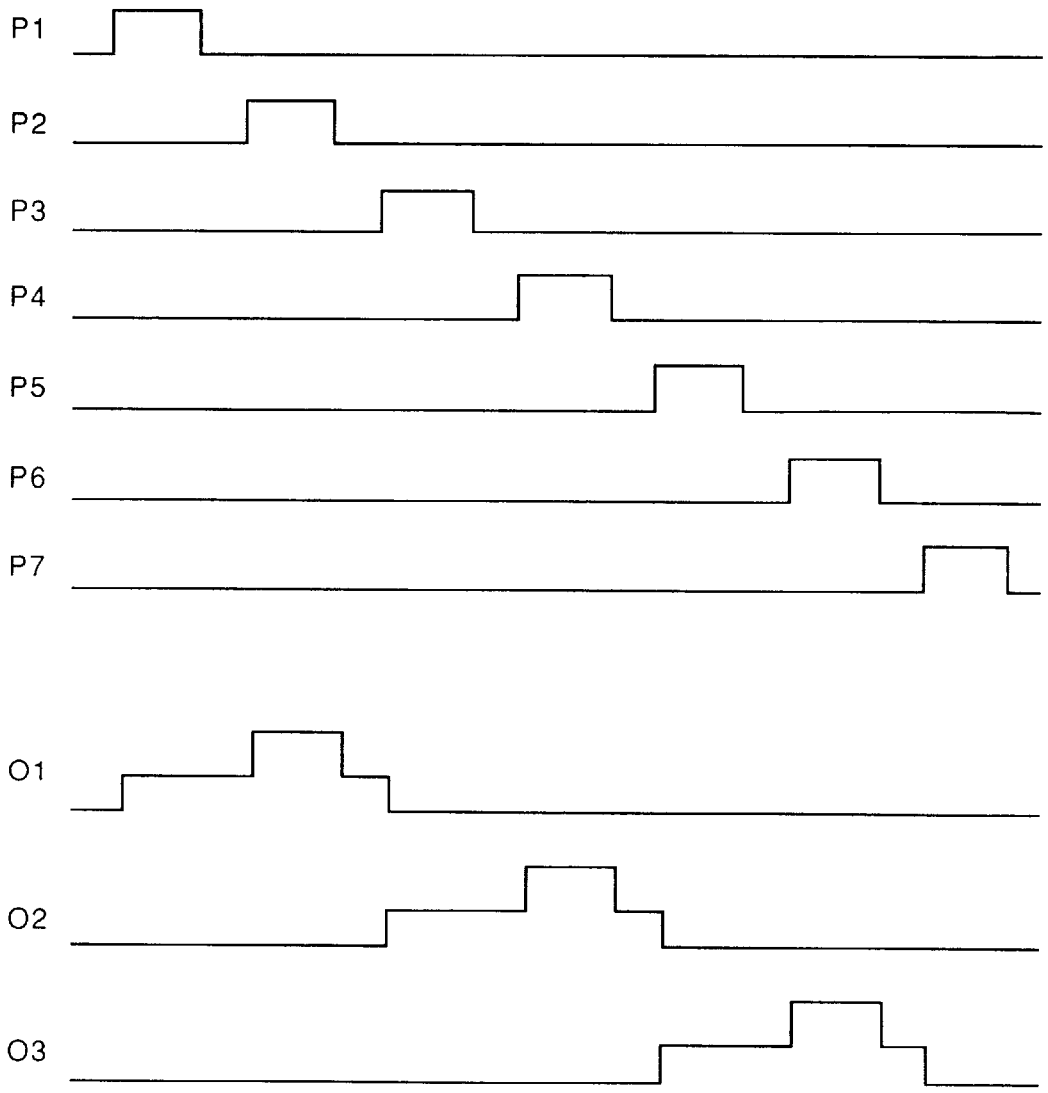
FIG. 2 is an operation timing chart of the drive circuit according to Embodiment 1 of the present invention.

The outputs from the shift register 101 are, as can be understood from P1 to P7 shown in FIG. 2, sequentially transmitted from the corresponding terminals while being freed from overlap in terms of time. The potential of the output terminal 01 is first raised to a level which is lower than the output voltage from P1 by a degree corresponding to the threshold value of the MOS transistor 102. In response to the signal from P2, the potential is then raised by a degree corresponding to the voltage which is the result of multiplication of the signal voltage P2 and the capacitance division ratio between the capacitor 103 and the gate capacity of the transistor 106 via the capacitor 103. Assuming that the output amplitude of P1 to P7 is 7V, the threshold voltage of the first MOS transistor 102 is 7V and the capacitance division ratio of the gate capacity of the capacitor 103 and that of the transistor 106 is 0.9, the voltage to be applied to the gate of the switching transistor 106 is, as expressed by the following equation, raised to 12.3 V, which is 1.76 times the operation voltage 7 V of the shift register 101.

$$\textit{Output terminal voltage}=(7-1)+7\times 0.9=12.3\ V$$

The circuit thus arranged is able to generate a high voltage level of 12.3 V while keeping the power supply voltage in the shift register 101 and to be applied to each transistor in this circuit at the aforesaid low level of 7 V. Therefore, a signal, the amplitude of which is 11V, can be treated.

Figure 3:
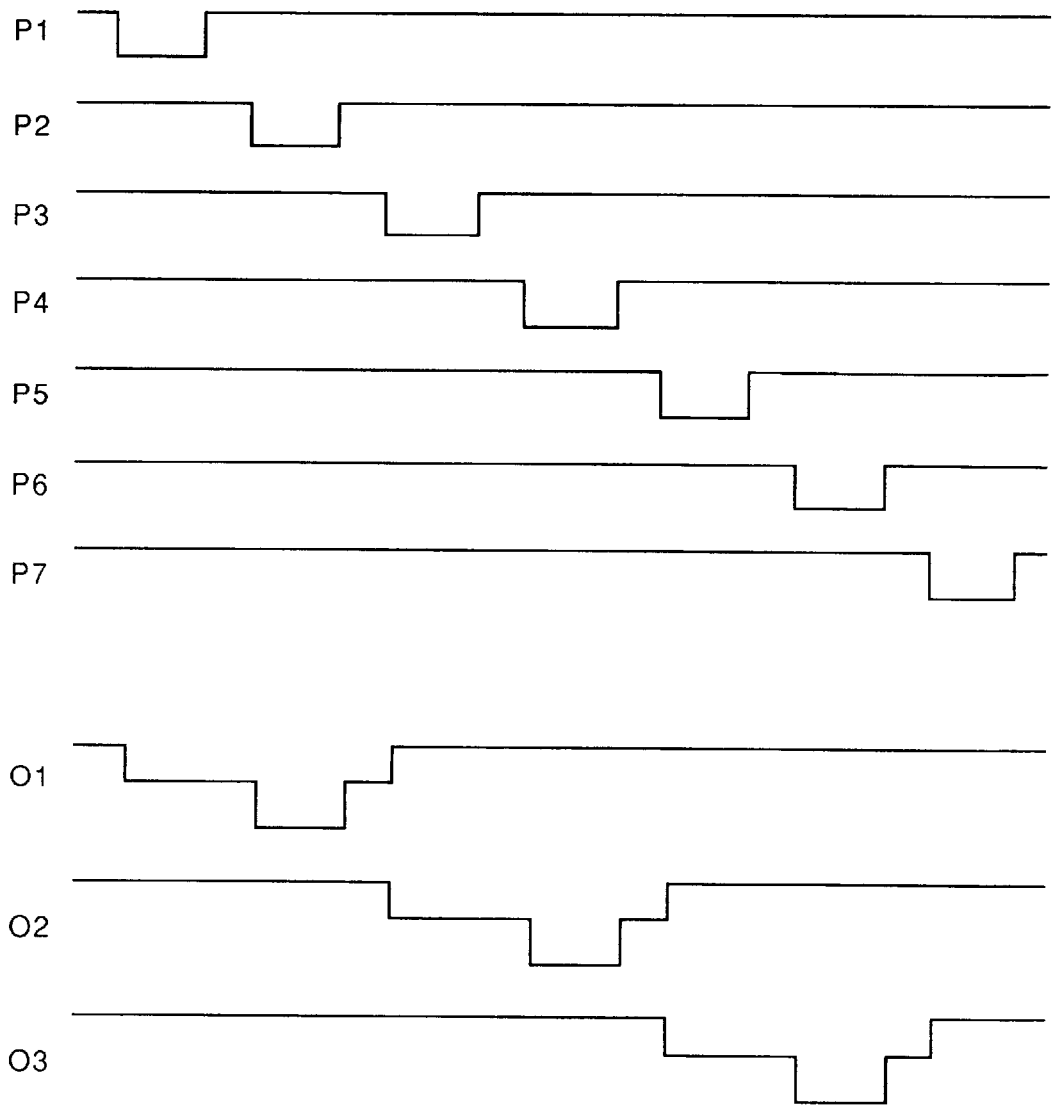
FIG. 3 is a timing chart for the drive circuit according to Embodiment 1 and partially using a PMOS transistor.
Figure 4:
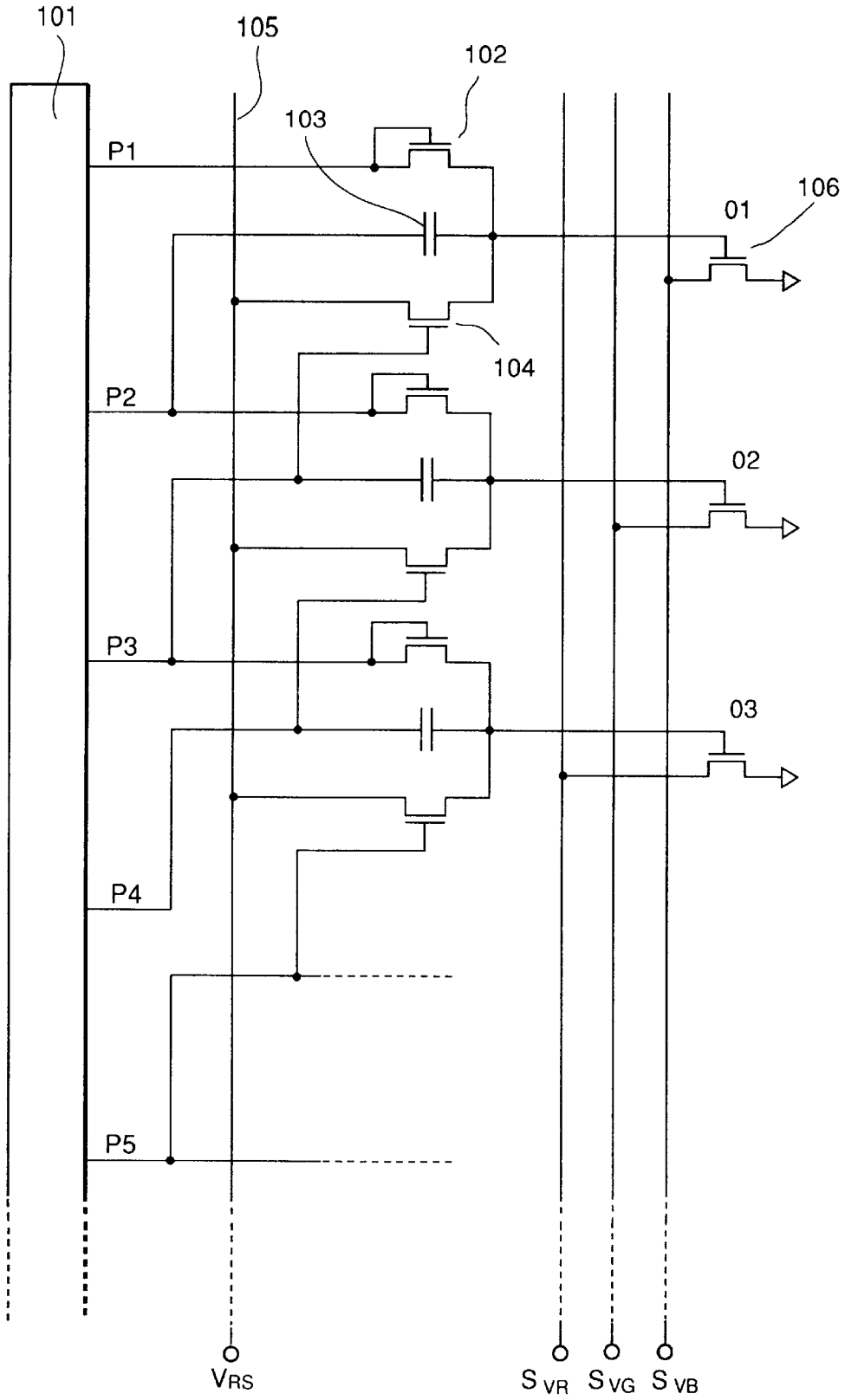
FIG. 4 illustrates a drive circuit for use in an active matrix liquid crystal light valve according to Embodiment 2 of the present invention.

A timing chart realized in the case where a PMOS is used as the switching transistor 106 is shown in FIG. 3. If the PMOS is used, a similar effect can be obtained.

Embodiment 2

Figure 5:
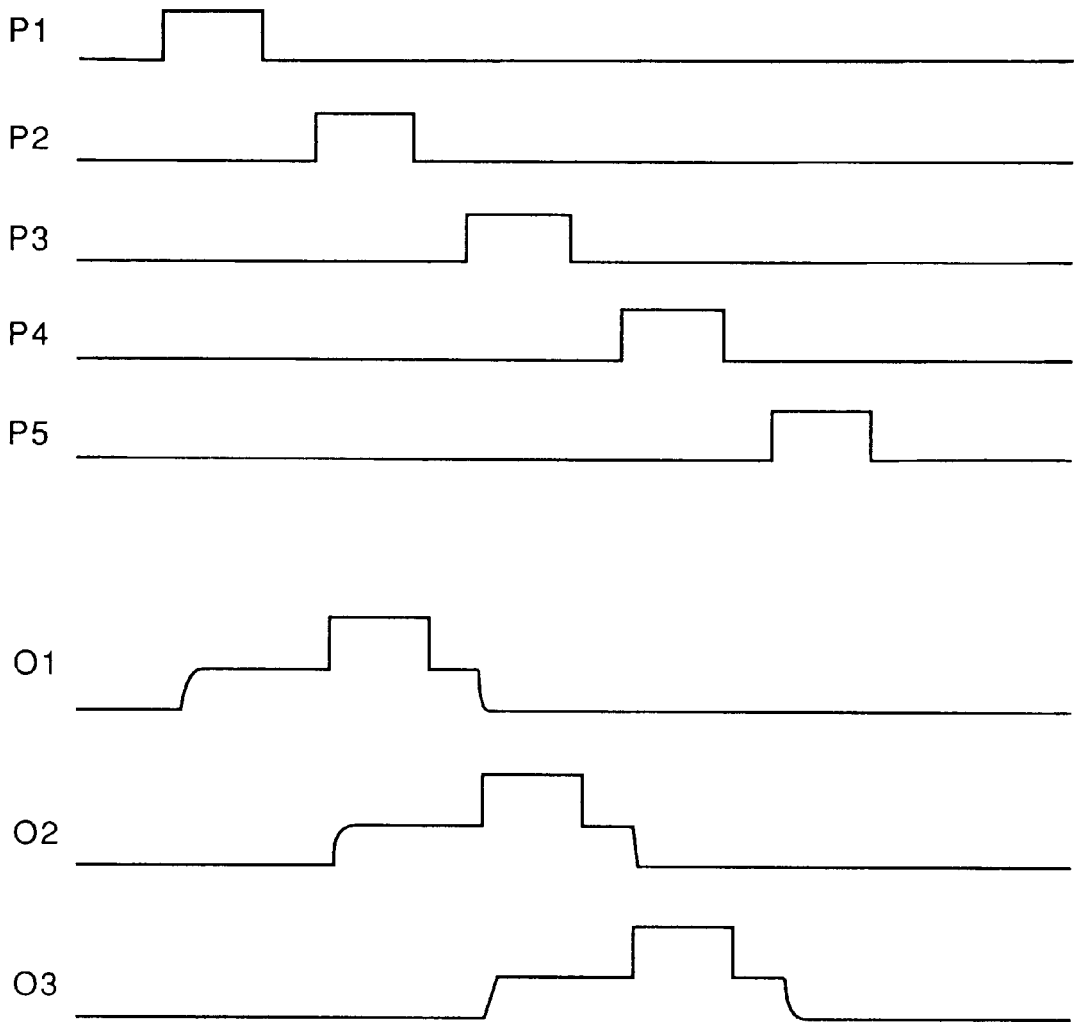
FIG. 5 is an operation timing chart of the drive circuit according to Embodiment 2 of the present invention.
Figure 6:
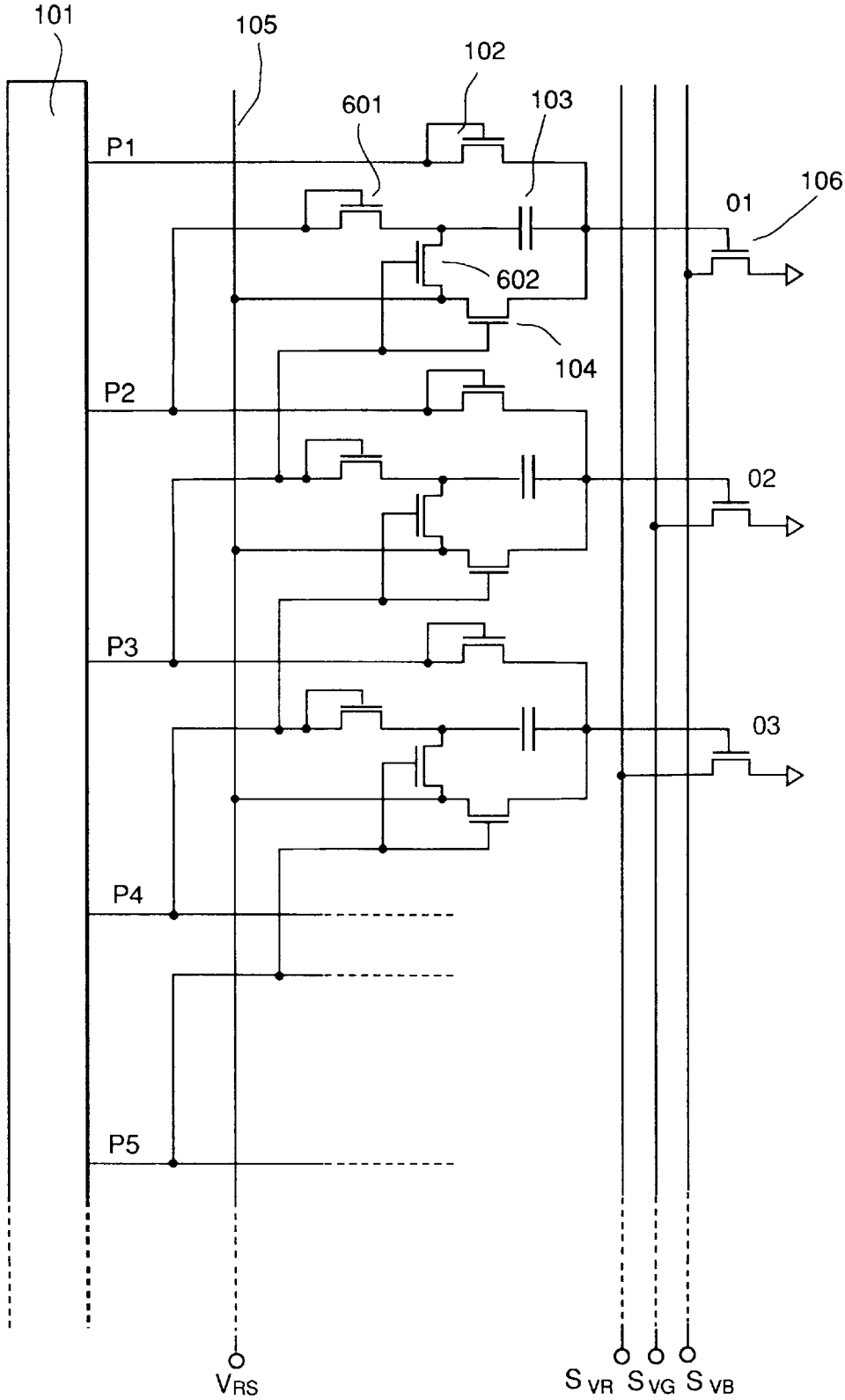
FIG. 6 illustrates a drive circuit for use in an active matrix liquid crystal light valve according to Embodiment 3 of the present invention.

FIG. 6 illustrates a circuit for use in a third embodiment. This embodiment is arranged in such a manner that the circuit according to the present invention is connected to the first output terminal P1, the second output terminal P2 and the third output terminal P3 of the shift register, and then the same is sequentially connected to the second output terminal P2, the third output terminal P3 and the fourth terminal P4 while being shifted by a degree of one terminal. The operation timing of this circuit is shown in FIG. 5. As can be understood from FIG. 5, outputs from the circuit according to this embodiment are overlapped for a certain period, so that operation speed can be raised in comparison to Embodiment 1 by overlapping the timing of the outputs in the case where a plurality of signal lines are connected by the switching transistor 106, for example in a case where signal lines corresponding R, G and B are used in a color panel.

Embodiment 3

Figure 7:
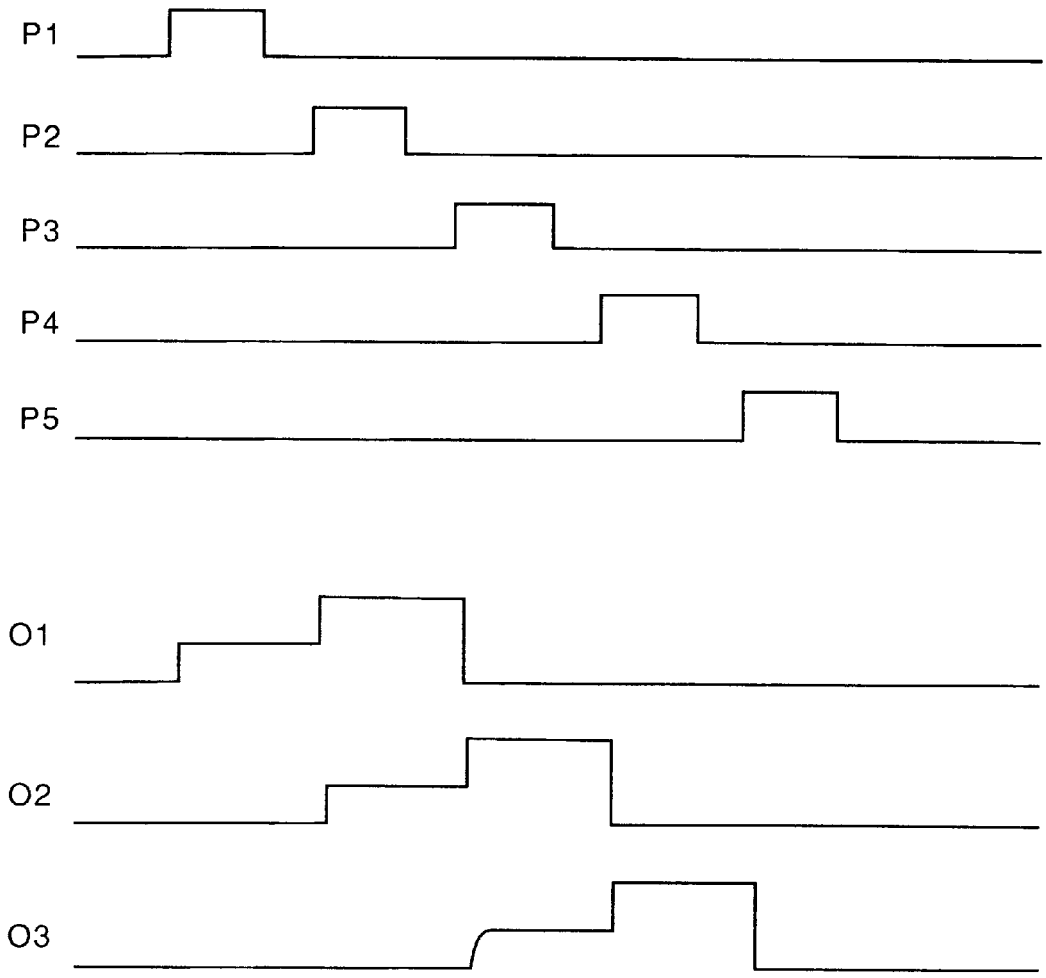
FIG. 7 is an operation timing chart of the drive circuit according to Embodiment 3 of the present invention.

FIG. 6 illustrates a circuit for use in a third embodiment. According to the Embodiment 1, the period in which a desired high potential can be maintained is limited to the period in which the signal P2 is outputted. However, this embodiment enables the potential of the first electrode of the capacitor to be maintained as shown in FIG. 7 although the output of the signal P2 has been ended and also the potential of the output from the second electrode can be maintained at a desired high level until the next signal P3 is supplied by arranging the structure in such a manner that a third MOS transistor 610 is inserted into a portion between the first electrode of the first capacitor and the output terminal P2 of the shift register, the source and the gate of the aforesaid MOS transistor are connected to the output terminal P2 and the drain of the same is connected to the first electrode of the first capacitor. As a result, the period in which the switching transistor is able to transfer the signal can be lengthened.

A reset transistor 602 is connected to the first electrode of the first capacitor, so that the potential of the first electrode is reset when the signal P3 is supplied.

Embodiment 4

Figure 8:
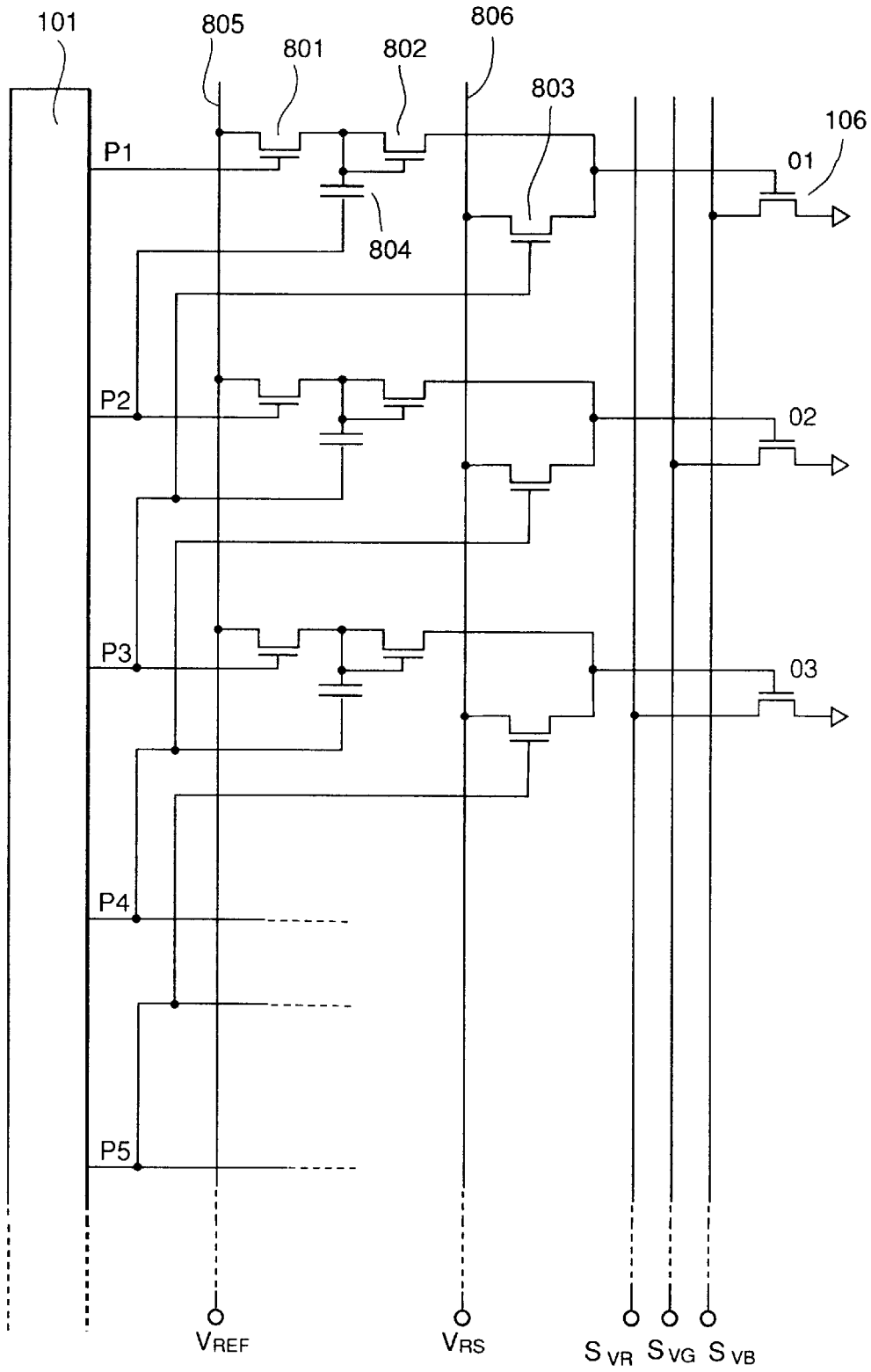
FIG. 8 illustrates a drive circuit for use in an active matrix liquid crystal light valve according to Embodiment 4 of the present invention.
Figure 9:
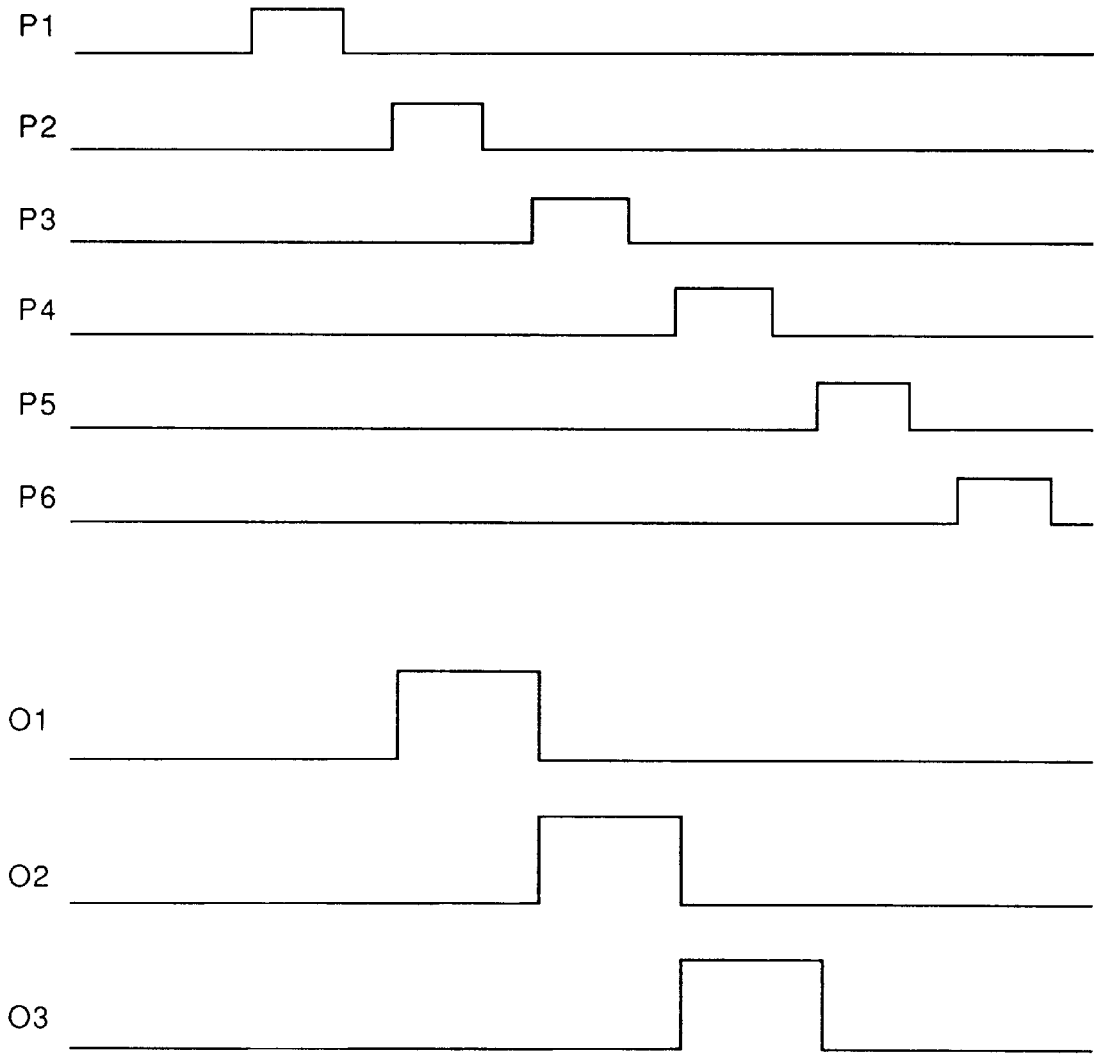
FIG. 9 is an operation timing chart of the drive circuit according to Embodiment 4 of the present invention.

FIG. 8 illustrates a circuit for use in a fourth embodiment of the present invention. This embodiment is constituted in such a manner that the voltage raising circuit is formed by using a charge pumping circuit. The circuit according to the fourth embodiment of the present invention comprises a fourth MOS transistor 801, a fifth MOS transistor 802, a sixth MOS transistor 803 and a second capacitor 804. The source of the fourth MOS transistor 801 is connected to a power source line VDD 805, while the gate is connected to the output terminal P1 of the shift register. Furthermore, the drain of the fourth MOS transistor 801, the source and the gate of the fifth MOS transistor 802 are connected to the first electrode of the second capacitor 804. The second electrode of the second capacitor 804 is connected to the output terminal P2, the source of the sixth MOS transistor 803 is connected to a power supply line VSS 806, the gate of the same is connected to the output terminal P3 of the sift register, and the drain of the fifth MOS transistor 802 and that of the sixth MOS transistor 803 are connected to each other so as to be an output terminal. The operation timing according to the fourth embodiment of the present invention is shown in FIG. 9. First, the signal P1 acts to raise the potential of the drain terminal of the fourth MOS transistor 801. Then, the signal P2 acts to further raise the potential via the capacitor 804 so as to output it. Then, resetting is performed in response to the signal P3. Also according to this embodiment, an effect similar to that obtainable from the aforesaid embodiments can be obtained.

Figure 11:
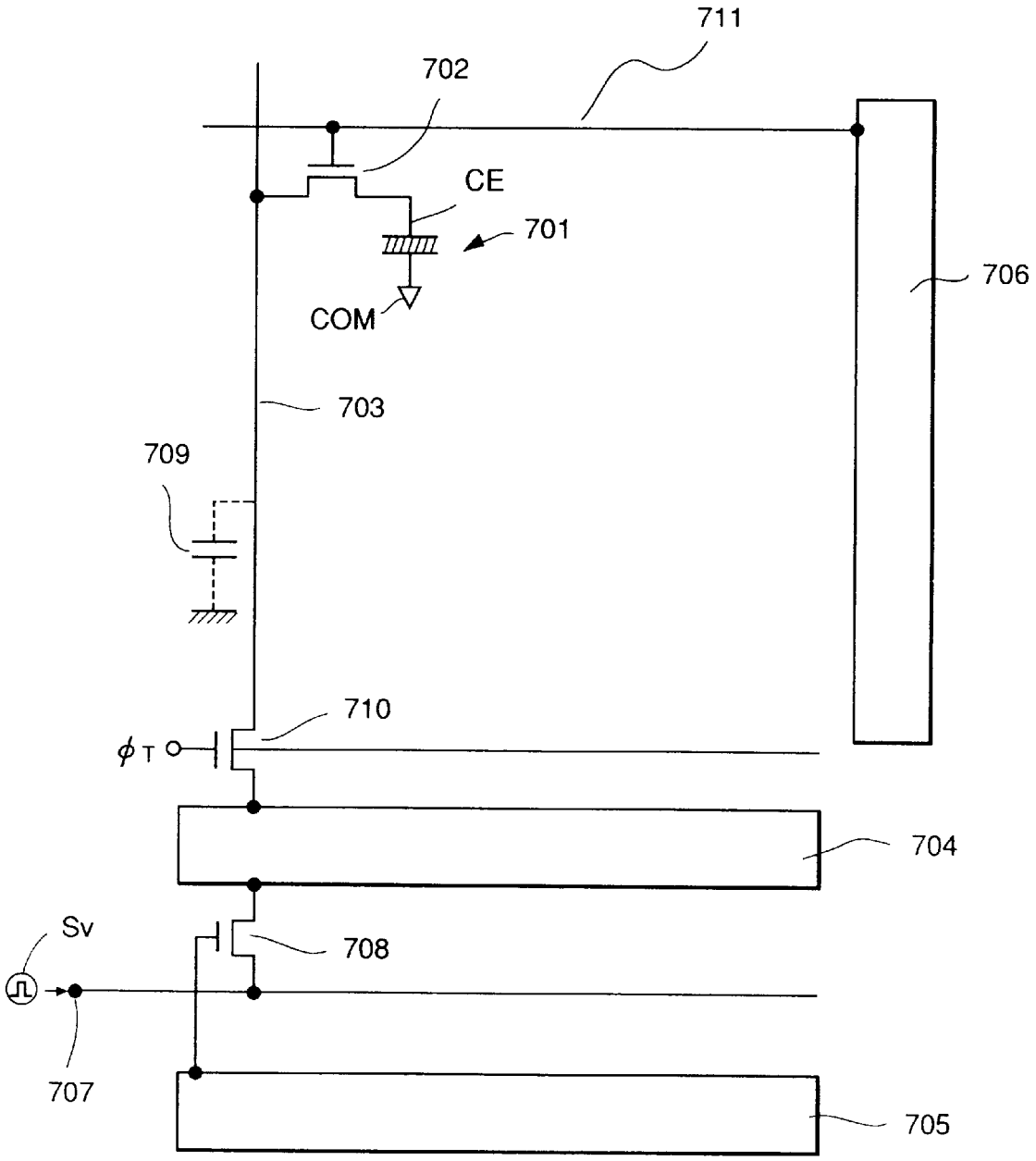
FIG. 11 PRIOR ART
FIG. 11 illustrates a circuit for a conventional liquid crystal display.
Figure 12:
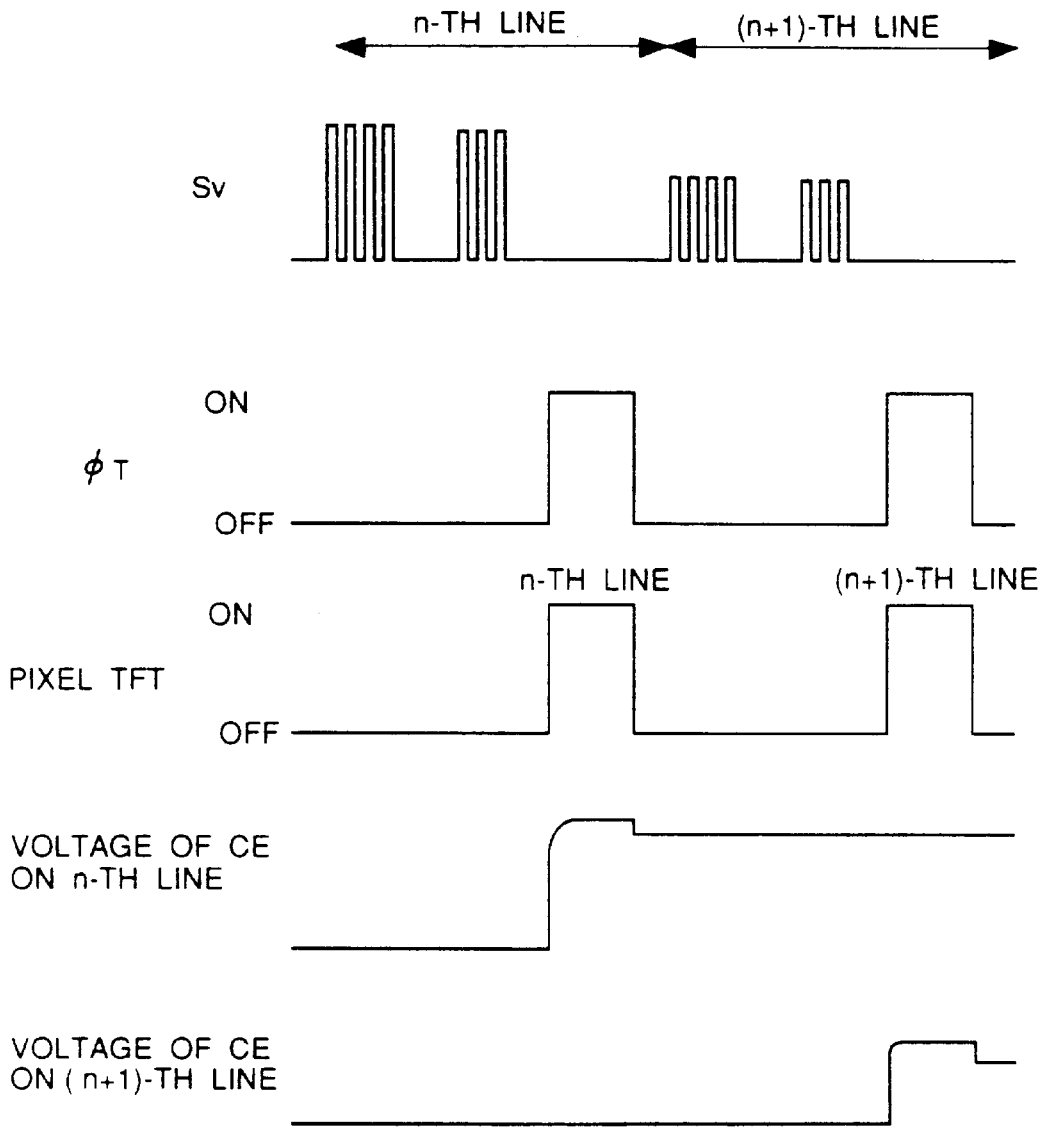
FIG. 12 PRIOR ART
FIG. 12 illustrates the timing of drive pulses for the active matrix liquid crystal display.
Figure 13:
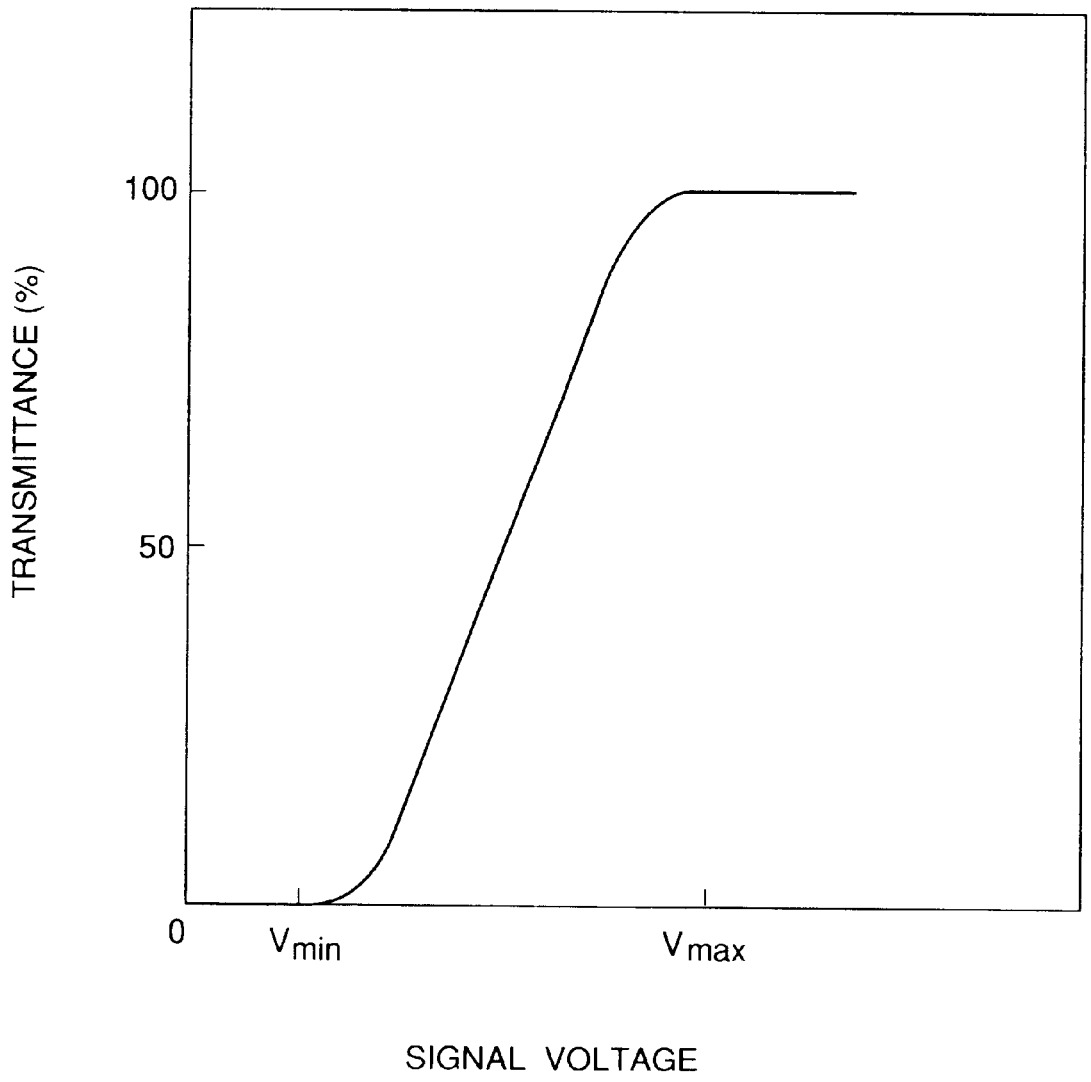
FIG. 13 is a graph which illustrates the correlation between the transmittance of a TN liquid crystal cell and the signal voltage.
Figure 14:
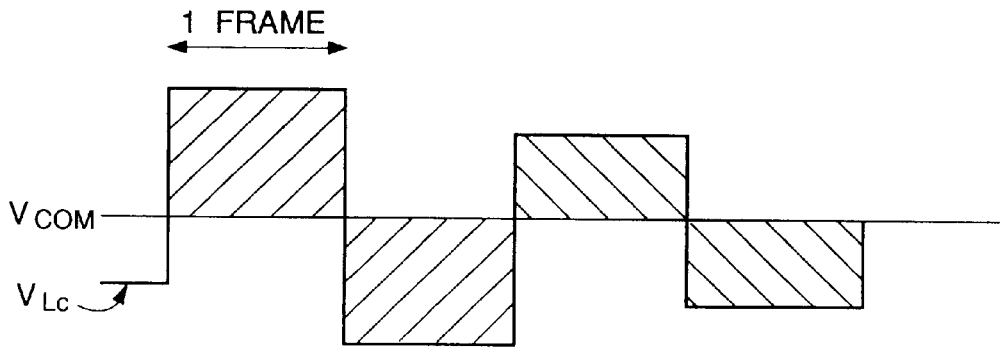
FIG. 14 illustrates the drive waveform in the active matrix liquid crystal display which uses the TN liquid crystal.
Figure 15:
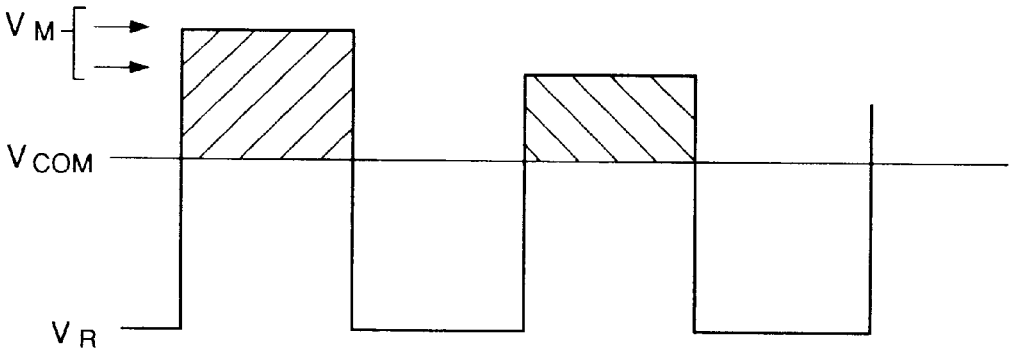
FIG. 15 illustrates the drive waveform in the active matrix liquid crystal display which uses ferroelectric liquid crystal.

The output (the video signal) from the switching transistor 106 according to the aforesaid Embodiments 1 to 4 is supplied to the signal line 704 via the line buffer 704 shown in FIG. 11 in the case where the line sequential drive method is employed. In another case where driving is sequentially performed in a time sequential manner for each pixel, the output is directly supplied to the signal line 704 in such a manner that the output does not pass through the line buffer 704.

The circuit according to Embodiments 1 to 4 is formed on a semiconductor substrate.

Figure 10:
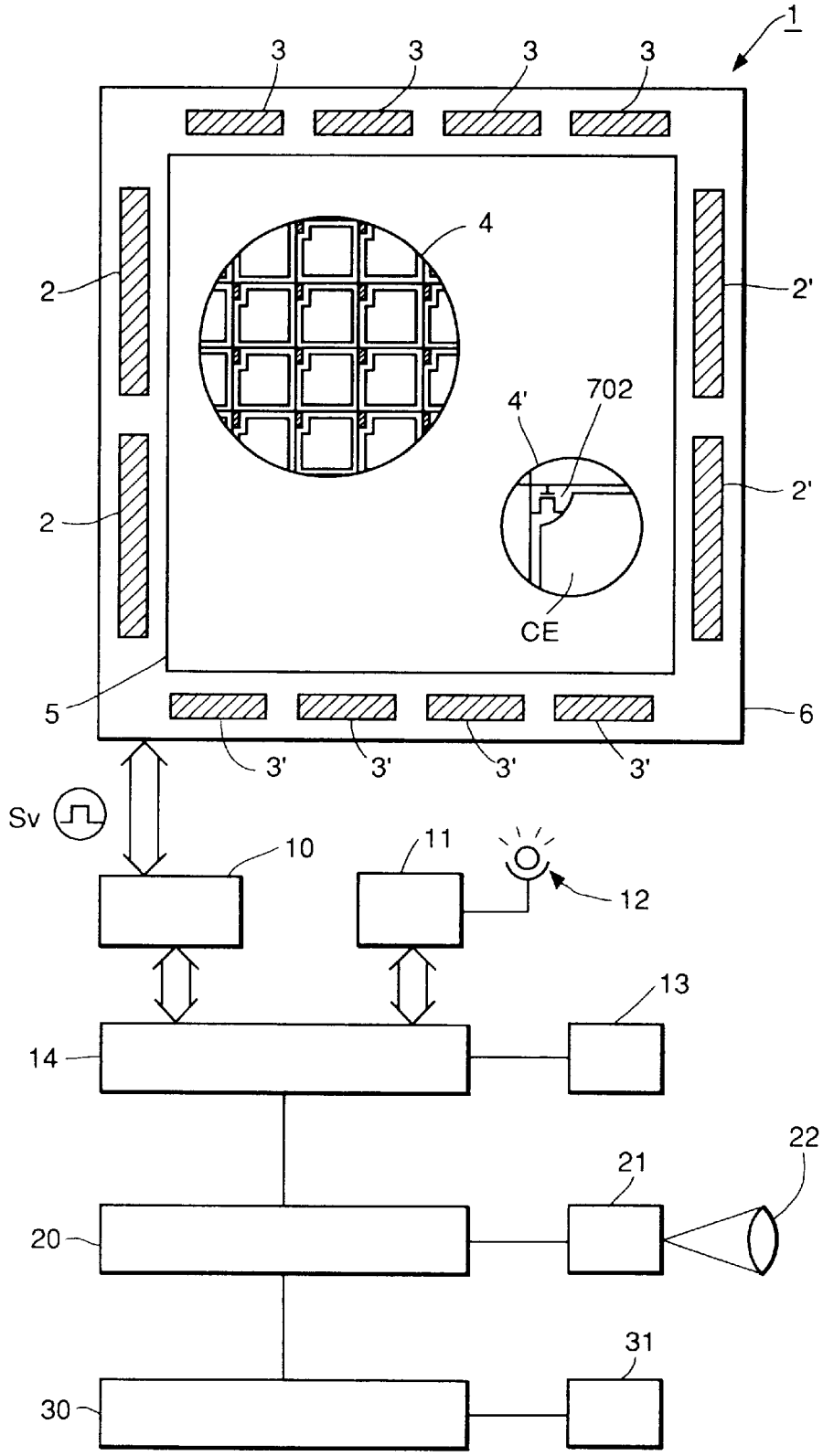
FIG. 10 is a schematic view which illustrates the structure of an image information processing apparatus which uses the liquid crystal light valve according to the present invention.

FIG. 10 is a schematic view which illustrates an image information processing apparatus which employs the AMLCD according to the present invention.

Reference numeral 1 represents an AMLCD having a display portion 5 formed at the central portion of a substrate 6 thereof. FIG. 10 is a partially enlarged view of the pixel portions given reference numerals 4 and 4'. A drive circuit including the shift register is disposed around the display portion 5. Horizontal drive circuits 3 and 3" connected to the signal line and arranged to supply the video signals are connected to the gate line, the horizontal drive circuits 3 and 3' respectively being disposed above and below the display portion. Drive circuits 2 and 2' for generating line selection signals are disposed to the right and left of the display portion 5.

The AMLCD 1 is structured in such a manner that the aforesaid drive circuits are connected to drive control circuit 10 mounted on an individual substrate. The drive control circuit 10 includes a circuit for dividing one video signal into a plurality of element signals (for example, $S_{VR}$, $S_{VG}$ and $S_{VB}$) in the case where it is designed to be adapted to Embodiments 2 to 4.

The drive control circuit 10 is, together with a lighting control circuit including a power source 12 and an inverter for controlling lighting of the light source, connected to a central processing circuit 14.

The image information processing apparatus according to this embodiment further comprises an optical system 22 including a lens through which image information is received, an image sensor 21 including a photoelectric conversion element and its drive circuit 20.

In addition, image information obtained by the image sensor 21 and/or displayed image information are recorded to a recording medium by a recording control circuit 30 including a recording head 31.

The active matrix liquid crystal display 1 can be formed on one substrate while including the liquid crystal device, the liquid crystal drive circuit and its peripheral drive circuit by using a semiconductor substrate having a single crystal Si layer and manufactured by the following method. The method will now be described.

The single crystal Si layer of the semiconductor substrate is formed by using a porous Si substrate obtained by making a single crystal Si substrate to be porous.

As a result of an observation performed by using a transmissive type electronic microscope, the porous Si substrate have pores, the mean diameter of which is about 600

Å formed therein. Furthermore, although the density is less than the half of that of the single crystal Si, single crystallinity is maintained. Therefore, a single crystal Si layer can be allowed to epitaxial-grow on a porous layer. However, the formed pores are again arranged if the temperature is higher than 1000° C., causing the characteristics of the acceleration etching to be lost. Therefore, it is considered preferable to cause the Si layer to epitaxial-grow by a molecular beam epitaxial grow method, a plasma enhanced CVD method, a thermal CVD method, a photo CVD method, a bias sputtering method or a liquid-phase crystal growth method.

A method of allowing the single crystal layer to epitaxial-grow after a P-type Si has been made to be porous type will now be described.

First, a Si single crystal substrate is prepared, and it is made to be a porous type by an anode forming method in which a HF solution is used. Although the density of the single crystal Si is 2.33 g/cm$^3$, the density of the porous Si substrate can be changed to 0.6 to 1.1 g/cm$^3$ by changing the concentration of the HF solution to 20 wt % to 50 wt %. The porous layer can easily be formed in the P-type Si substrate because of the following reasons:

The porous Si was found during research of electrolytic polishing. In a dissolution reaction of Si in the anode formation, the anode reaction of Si in a HF solution requires positive holes, the anode reaction being expressed as follows:

$$Si+2HF+(2-n)\,e^{+}\rightarrow SiF_2+2H^{+}+ne^{-}$$

$$SiF_2+2HF\rightarrow SiF_4+H_2$$

$$SiF_4+2HF\rightarrow H_2SiF_6$$

or $$Si+4HF+(4-\lambda)e^{+}\rightarrow SiF_4+4H^{+}+\lambda e^{-}$$

$$SiF_4+2HF\rightarrow H_2SiF_6$$

where $e^+$ and $e^-$ respectively denote a positive hole and electron, and n and $\lambda$ respectively denote the number of positive holes required to dissolve one Si atom. If n>2 or $\lambda$>4, the porous Si can be formed.

Therefore, it can be said that the P-type Si having the positive holes can easily be made to be the porous type.

Another fact that a high density N-type Si can be made to be a porous type has been reported. Hence, the porous Si can be made to be the porous type regardless of the type of the Si.

Since the porous layer has a large quantity of gaps formed therein, its density is reduced to the half or less. As a result, the surface area significantly increases as compared with the volume, causing the speed, at which it is chemically etched, to be raised considerably in comparison to the speed at which an ordinary single crystal layer is etched.

Then, the conditions for making the single crystal Si to be porous type by anode forming will now be described. It should be noted that the starting material to form the porous Si by anode forming is not limited to the single crystal Si, but Si of a type having another crystal structure may be employed.

Applied voltage: 2.6 V

Current density: 30 mA·cm$^{-2}$

Anode forming solution: HF:$H_2O$:$C_2H_5OH$=1:1:1

Time: 2.4 hours

Thickness of porous Si: 300 $\mu$m

Porosity: 56%

Then, Si is allowed to epitaxial-grow on the porous Si substrate thus formed, so that a single crystal Si thin film is formed. It is preferable that the thickness of the single crystal Si thin film be 50 $\mu$m or less, more preferably 20 $\mu$m or less.

Then, the surface of the single crystal Si thin film is oxidized, and a substrate which finally forms the substrate is prepared, and the oxidized film on the surface of the single crystal Si and the aforesaid substrate are bonded to each other. As an alternative to this, the surface of a single crystal Si substrate is oxidized, and it is bonded to the single crystal Si layer. The reason why the aforesaid oxidized film is formed between the substrate and the single crystal Si layer lies in that the interfacial level generated from the base interface of a Si active layer can be lowered in the oxidized layer interface as compared with the aforesaid glass interface in the case where glass is used as the substrate and therefore the characteristics of the electronic device can be significantly improved. As an alternative to this, only a single crystal Si thin film, from which the porous Si substrate has been removed by selective etching, may be bonded to a new substrate. Although the aforesaid members can be bonded closely due to van der Waals force simply by making them come in contact with each other at the room temperature after their surfaces have been cleaned, they are heated at a temperature of 200 to 900° C. under nitrogen atmosphere, preferably 600 to 900° C.

Then, a $Si_3N_4$ layer is deposited on the overall surface of the two substrates bonded so as to serve as an etching prevention film, and only the $Si_3N_4$ layer formed on the surface of the porous Si substrate is removed. An apiezon wax may be used in place of the aforesaid $Si_3N_4$ layer. Then, the porous Si substrate is completely removed by etching or the like, so that the semiconductor substrate having the thin film single crystal Si layer can be obtained.

Then, a selective etching method for electroless- and wet-etching only the porous Si substrate will now be described.

As etching liquid which does not etch crystal Si but which is able to selectively etch only the porous Si, any of the following materials can be preferably employed: buffered hydrofluoric acids such as a hydrofluoric acid, an ammonium fluoride ($NH_4F$) and a hydrogen fluoride (HF); a mixture solution of a hydrofluoric acid or a buffered hydrofluoric acid prepared by adding a hydrogen peroxide solution; a mixture solution of a hydrofluoric acid or a buffered hydrofluoric acid prepared by adding alcohol; or a mixture solution of a hydrofluoric acid or a buffered hydrofluoric acid prepared by adding a hydrogen peroxide and alcohol. The bonded substrates are wetted with the aforesaid solution so that etching is performed. The etching speed depends upon the concentration of the hydrofluoric acid, the buffered hydrofluoric acid and the hydrogen peroxide solution and upon the temperature. By adding the hydrogen peroxide solution, the oxidation of Si is accelerated and therefore the reaction speed can be raised as compared with the method in which they are not added. Furthermore, the reaction speed can be controlled by changing the ratio of the hydrogen peroxide. By adding alcohol, bubbles of a gas generated due to the reaction taken place in the etching process can be immediately removed from the etched surface while eliminating a necessity of performing stirring. Therefore, the porous Si can be uniformly and efficiently etched.

It is preferable that the concentration of HF contained in the buffered hydrofluoric acid be ranged from 1 to 95 wt %, preferably from 1 to 85 wt %, and more preferably from 1 to 70 wt %. It is preferable that the concentration of $NH_4F$ contained in the buffered hydrofluoric acid be ranged from 1 to 95 wt %, preferably from 5 to 90 wt %, and more preferably from 5 to 80 wt %.

It is preferable that the concentration of HF with respect to the etching solution be ranged from 1 to 95 wt %, preferably 5 to 90 wt % and more preferably from 5 to 80 wt %.

The concentration of $H_2O_2$ with respect to the etching solution be ranged from 1 to 95 wt %, preferably 5 to 90 wt %, and more preferably 10 to 80 wt % while offering the effect of the hydrogen peroxide solution.

The concentration of alcohol with respect to the etching solution be 80 wt % or less, preferably 60 wt % or less, and more preferably 40 wt % or less while offering the effect of the alcohol.

It is preferable that the temperature be 0 to 100° C., preferably 5 to 80° C., and more preferably 5 to 60° C.

The alcohol for use in the process according to this embodiment is not limited to ethyl alcohol, but it may be alcohol such as isopropyl alcohol which does not arise a practical problem during the manufacturing process and which enables the effect required for the added alcohol to be obtained.

The semiconductor substrate thus obtained has the single crystal Si layer formed similarly to that of an ordinary wafer in such a manner that it is flattened and thinned to have a large area on the overall surface of the substrate.

The single crystal Si layer of the semiconductor substrate is separated by a partial oxidation method or by etching so as to be formed into an island, so that impurities are doped and a p- or n-channel transistor is formed.

Embodiment 5

Figure 16:
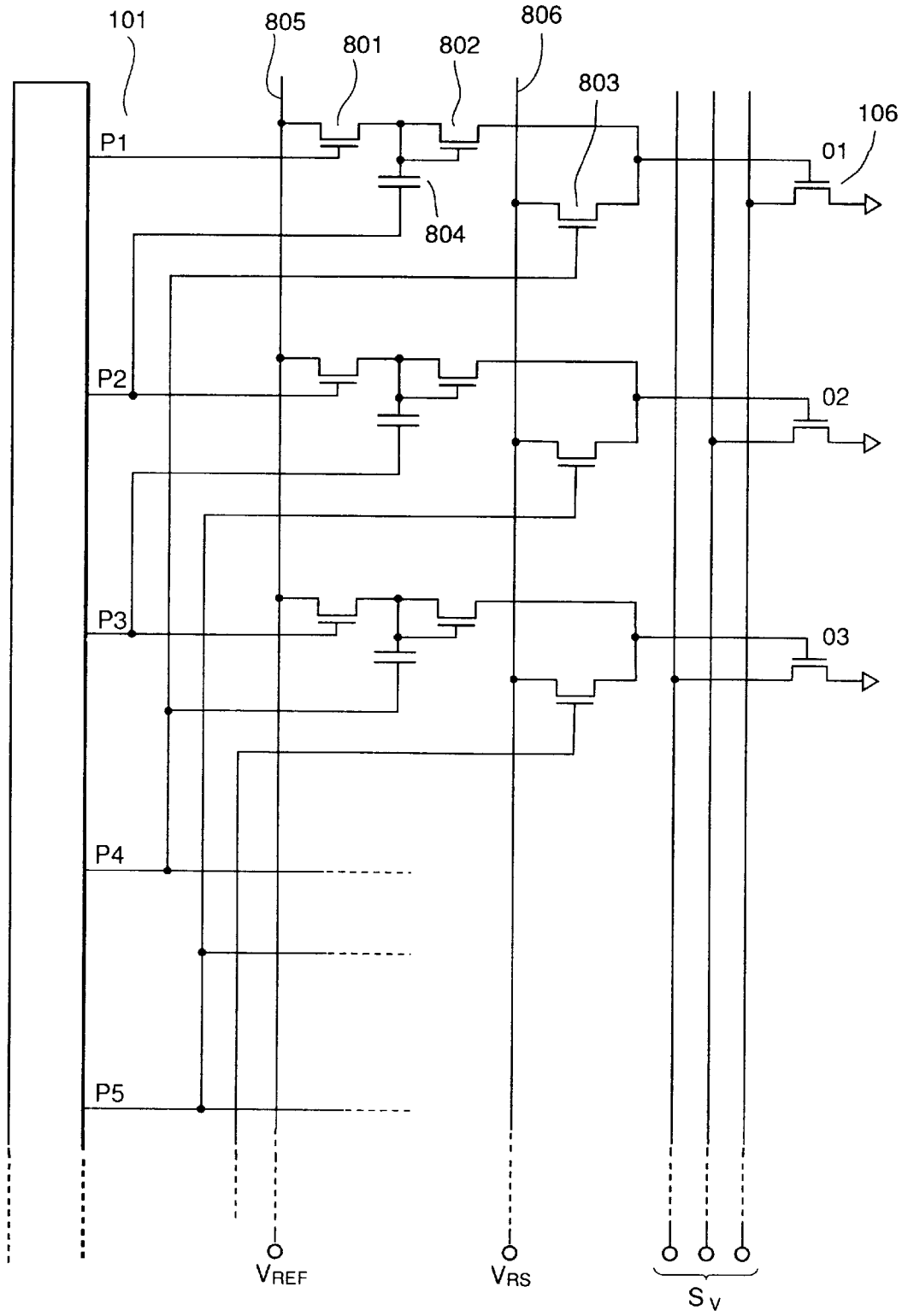
FIG. 16 illustrates a drive circuit for use in an active matrix liquid crystal light valve according Embodiment 5 of the present invention.
Figure 17:
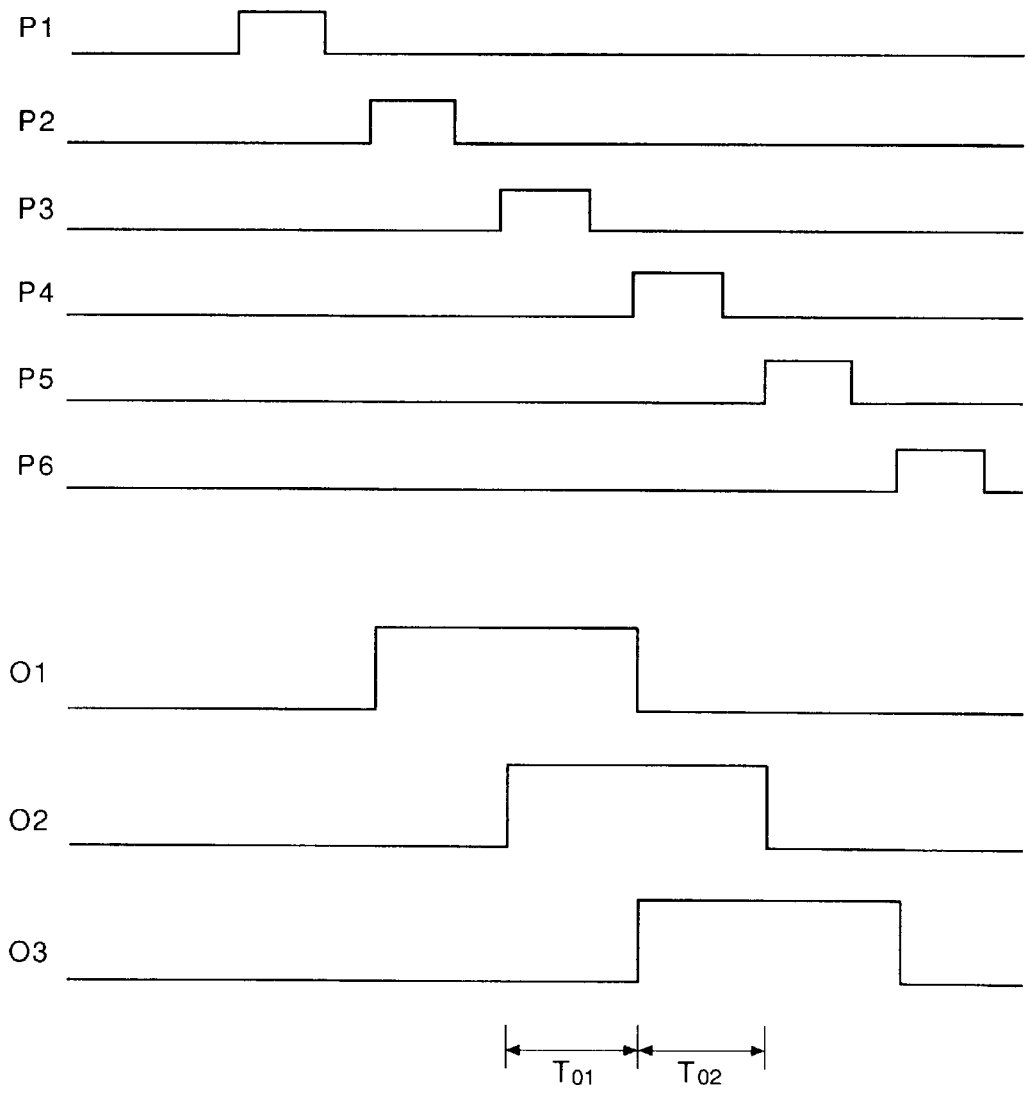
FIG. 17 is an operation timing chart of the drive circuit according to Embodiment 5 of the present invention.

FIGS. 16 and 17 respectively are a view which illustrates a drive circuit for use in a liquid crystal light valve according to the present invention and a timing chart of the drive circuit.

This embodiment is arranged to partially improve Embodiment 4 and the residual structures are the same as those according to Embodiment 4.

The circuit is arranged in such a manner that the terminals of the shift register are connected while being shifted rearwards in such a way that the gate of the MOS transistor 803 is connected to the terminal P4, so that the resetting timing (ON) of a terminal of the voltage raising circuit and the setting timing (OFF) of the next terminal are made opposite in terms of time so that overlapping period $T_{01}$ and $T_{02}$ are sequentially created. Furthermore, a register which acts at a high frequency is employed as the shift register 101. As a result, the speed of processing signals to be written to the output side of the switch 106 can be raised.

Although the voltage raising circuit and the overlap drive are combined according to this embodiment similarly to Embodiments 2 and 3, another structure may be employed in which no voltage raising circuit is used and the shift pulses of the shift register are simply overlapped when they are supplied while eliminating the process of raising the voltage.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. An active matrix liquid crystal light valve having a plurality of cells each including liquid crystal and an active element, said active matrix liquid crystal light valve comprising:

a circuit which operates a transistor switch for transferring signals through a source and a drain of said transistor switch to be respectively supplied to said cells and which has a shift register and voltage raising means connected to a gate of said transistor switch for raising a voltage of said shift register, wherein:

said voltage raising means has a first MOS transistor, a second MOS transistor, and a capacitor; and a gate and a source of said first MOS transistor are connected to a first output of said shift register, a first electrode of the capacitor is connected to a second output of said shift register, a gate of said second MOS transistor is connected to a third output of said shift register, a source of said second MOS transistor is connected to a resetting power supply line individually provided, and a drain of said first MOS transistor, a second electrode of the capacitor and a drain of said second MOS transistor are connected to one another.

2. An active matrix liquid crystal light valve having a plurality of cells each including liquid crystal and an active element, said active matrix liquid crystal light valve comprising:

a circuit which operates a transistor switch for transferring signals through a source and a drain of said transistor switch to be respectively supplied to said cells and which has a shift register and voltage raising means connected to a gate of said transistor switch for raising a voltage of said shift register, wherein:

said voltage raising means has a fourth MOS transistor, a fifth MOS transistor, a sixth MOS transistor, and a second capacitor;

a source of said fourth MOS transistor is connected to a power supply line, a gate of said fourth MOS transistor is connected to a first output terminal of said shift register, a drain of said fourth MOS transistor, a source and a gate of said fifth MOS transistor, and a first electrode of said second capacitor are connected to each other; and a second electrode of said second capacitor is connected to a second output terminal of said shift register, a source of said sixth MOS transistor is connected to a resetting power supply line, a gate of said sixth MOS transistor is connected to a third output terminal of said shift register, and a drain of said fifth MOS transistor and a drain of said sixth MOS transistor are connected to each other.

* * * * *

UNITED STATES PATENT AND TRADEMARK OFFICE

CERTIFICATE OF CORRECTION

PATENT NO. : 6,133,897
DATED : October 17, 2000
INVENTOR(S) : Tetsunobu Kouchi

It is certified that error appears in the above-identified patent and that said Letters Patent is hereby corrected as shown below:

Column 3,
Line 15, "VMAX" should read -- Vmax --.

Column 4,
Line 37, "be" should be deleted.

Column 11,
Line 34, "respectively are a view which illustrates" should read -- are respectively views which illustrate --; and
Line 61, "particularly," should read -- particularity, --.

Signed and Sealed this

Fifth Day of February, 2002

*Attest:*

*Attesting Officer*

JAMES E. ROGAN
*Director of the United States Patent and Trademark Office*